US005988255A

United States Patent [19]

Wigglesworth, III

[11] Patent Number: 5,988,255

[45] Date of Patent: Nov. 23, 1999

[54] PORTABLE WALL AND METHODS OF MAKING SAME

[76] Inventor: Albert Gifford Wigglesworth, III, 60 Border St., E. Boston, Mass. 02128

[ * ] Notice: This patent is subject to a terminal disclaimer.

[21] Appl. No.: 08/384,829

[22] Filed: Feb. 7, 1995

[51] Int. Cl.[6] ..... A47G 5/00

[52] U.S. Cl. ..... 160/135; 160/352

[58] Field of Search ..... 160/135, 351, 160/352, 405; 40/605, 606, 610, 611

[56] References Cited

U.S. PATENT DOCUMENTS

| | | | |
|---|---|---|---|
| 2,070,544 | 2/1937 | Clark . | |
| 3,571,999 | 3/1971 | Downing | 40/605 X |
| 3,913,656 | 10/1975 | Guyer | 160/135 |
| 4,102,525 | 7/1978 | Albano | 248/175 |
| 4,415,077 | 11/1983 | Murphy | 206/44 R |
| 4,761,922 | 8/1988 | Black | 160/135 |
| 4,865,111 | 9/1989 | Perutz | 160/135 |
| 4,979,554 | 12/1990 | Nelson | 160/135 |
| 4,991,813 | 2/1991 | Beaulleu | 248/469 |
| 5,269,112 | 12/1993 | Weirub et al. | 40/610 |
| 5,388,382 | 2/1995 | Brooks | 160/135 X |
| 5,439,043 | 8/1995 | Carter | 160/135 |

*Primary Examiner*—David M. Purol
*Attorney, Agent, or Firm*—Schwartz & Weinrieb

[57] ABSTRACT

A portable wall assembly and methods of making same include support columns made from thin flexible sheets rolled into free standing cylinders. Wall panels also made from thin flexible sheets may be attached to the support columns. After disassembly of the wall, the sheets can be spiraled into a nested circular bundle for storage and transportation.

14 Claims, 3 Drawing Sheets

PORTABLE WALL AND METHODS OF MAKING SAME

BACKGROUND OF THE INVENTION

This invention relates to wall structures, and more particularly to portable free standing walls used for exhibits, trade shows, and the like, where temporary displays are needed. Numerous types of dismantleable structures have been used to satisfy the need for portable walls. However, the prior wall structures typically require numerous types of loose parts of different sizes that must be fitted together by skilled workers, and such parts can be lost when these prior structures are disassembled and stored or transported to different locations. Also, parts which can be easily bent or otherwise distorted when handled during disassembly and transportation can hinder or delay assembly of the prior wall structures at a new location when time is at a premium. Many prior portable walls also were bulky when disassembled or required special containers for storage and transportation.

OBJECTIVES OF THE INVENTION

Accordingly, it is an object of this invention to provide improved movable wall structures and methods of making such walls.

Another object is to provide portable walls that do not require numerous differently sized or interconnected parts that are easily lost or damaged during disassembly, storage or transportation of the walls.

A further object is to provide methods of making portable walls that can be rolled into a compact bundle for storage and transport.

Another object is to provide a unitary, collapsible support column that can be erected and taken down without the use of external parts or tools.

An additional object is to provide support columns and wall panels that are made from components that can be rolled together into a compact circular bundle for storage and transport.

A still further object is to proved portable walls that can be stored and transported in commonly available types of containers, and methods of making such walls.

Another object is to provide portable wall assemblies whose size can be easily changed.

An additional object is to provide improved methods for erecting, taking down, disassembling, storing and transporting portable wall assemblies.

A further object is to provide portable walls that can be made from thin sheets of flexible material.

Another object is to provide free standing, lightweight, attractive, durable, relatively inexpensive portable walls, that can be erected and disassembled by unskilled workers without the use of special tools, which can be stored and transported as compact bundles in ordinary containers, and which do not possess defects or disadvantages found in similar prior art structures.

Other objects and advantages of the methods and apparatus incorporating this invention will be found in the specification and claims, and the scope of the invention will be set forth in the claims.

DESCRIPTION OF THE INVENTION

Figure 1:
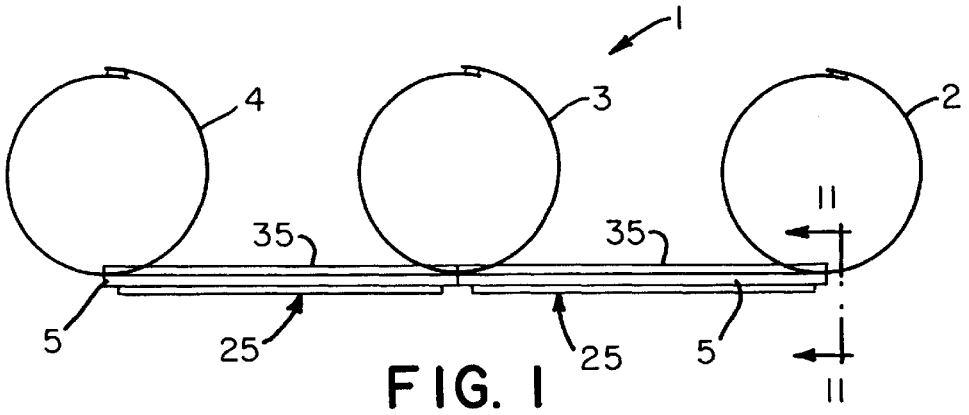
FIG. 1 is a schematic top plan view of wall structure in accord with this invention.
Figure 2:
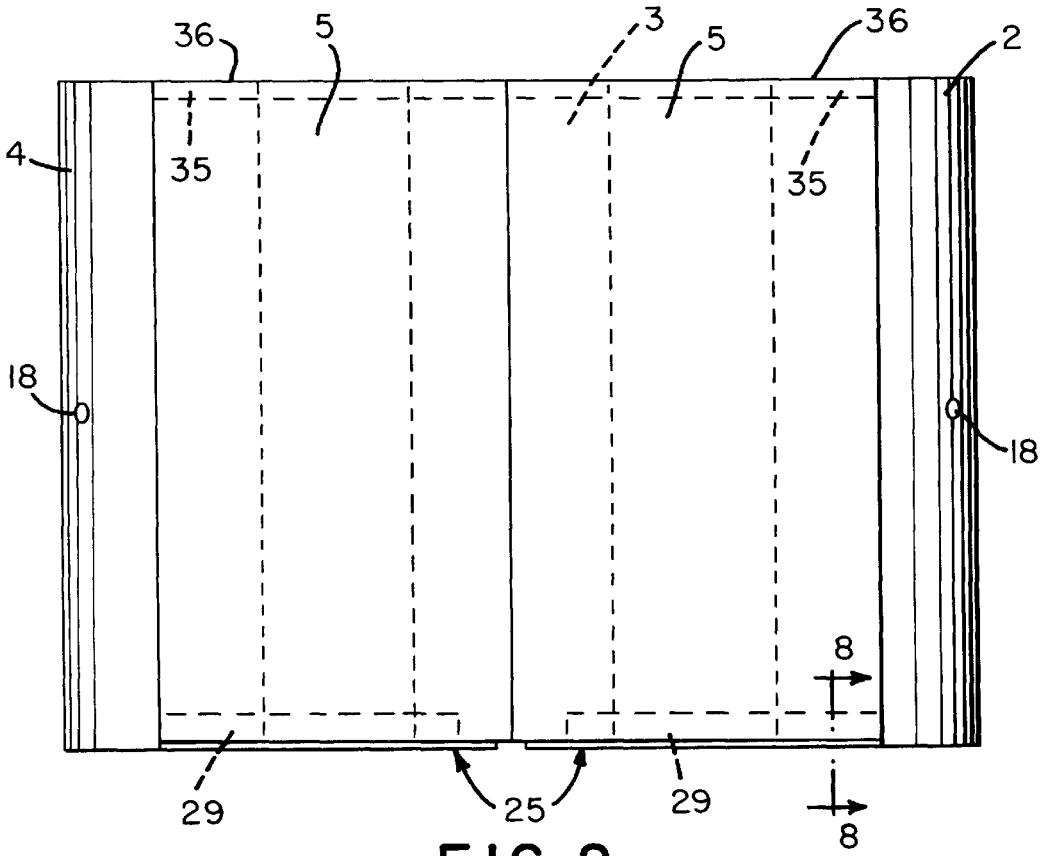
FIG. 2 is a front elevational view of the wall structure shown in FIG. 1.

The drawing shows a portable wall assembly 1 in accord with this invention. The wall assembly may employ one or more elongated, hollow, open-ended wall support columns 2, 3 and 4 for holding up one or more wall panels 5 that extend tangentially from the columns. Each support column may be made from an essentially rectangular sheet 6 of flexible material having a pair of opposed parallel side edges 7 and 8. First releasable fastening means 10 are located on sheet 6 adjacent edges 7 and 8. Preferably, releasable fastening means 10 is made from a pair of mating fastener members 11 and 12, such as hook and loop fasteners of the type sold under the registered trademark VELCRO, or commercially available magnetic strip fasteners. It is also possible to use various types of two-part snap fasteners, and the like. One fastener member 11 should be attached to one surface 14 of sheet 6, and the other fastener member 12 should be attached to the opposite surface 15 of the sheet.

Figure 5:
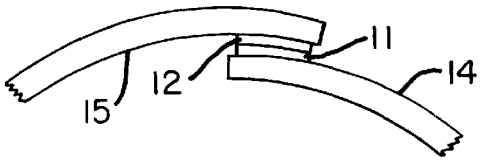
FIG. 5 is an enlarged, fragmentary top plan view of the ends of an assembled column.
Figure 6:
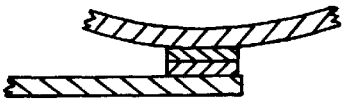
FIG. 6 is an enlarged, fragmentary cross sectional top view of the connection between a wall panel and a column.

Each of columns 2, 3 and 4 is formed by coiling a sheet 6 upon itself until side edges 7 and 8 overlap; as shown in FIG. 5. Then mating fastener members 11 and 12 can be joined together, as for example by pressing together the two mating members of a long hook and loop strip fastener or the members of a long magnet strip fastener. The resulting hollow open-ended column will essentially have the shape of a right circular cylinder. The shape of the columns 2, 3 and 4 will deviate somewhat from that of a perfect right circular cylinder because of the overlapping of edges 7 and 8, and because the flexibility of sheet 6 may allow the columns to deform slightly. However, to provide the wall assembly 1 with maximum column strength, the columns 2, 3 and 4 should adhere to as closely as possible to the shape of a right circular cylinder.

Each of the sheets 6 should have appropriately placed second releasable fastening means 16 on its surface 14, which will be the outside surface of a column, for mating with corresponding releasable fastening means 17 on a wall panel 5. Each sheet 6 may include several hand holes 18 to facilitate lifting and moving of the completed columns. Sheets 6 should be made from flexible flat material that is easily coiled upon itself, yet has sufficient rigidity or strength to be self-supporting when it is coiled into a cylindrical shape as described herein, and to support one or more wall panels 5, as shown in the drawing. Examples of such flexible material suitable for sheets 6 are PVC, styrene, or polycarbonate flat sheets approximately 0.030 inches in thickness, and other flexible synthetic plastic materials and combinations of such materials.

Figure 7:
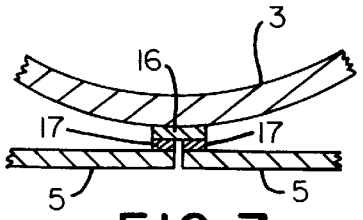
FIG. 7 is an enlarged, fragmentary cross sectional top view of the connection between two wall panels and a column.

Each wall panel 5 may be made from an essentially rectangular, flat sheet 20 of flexible material that is dimensioned to span the space between two or more of the support columns. Releasable fastening means 17 should be located adjacent opposite edges 21 and 22 of sheet 20 for supporting wall panel 5 on the upright columns. The mating releasable fastening means 16 and 17 may be of the same types described above with reference to first fastening means 10. Adjacent wall panels 5 may be attached to a common fastening means 16 on the same support column, as shown in FIG. 7.

Figure 12:
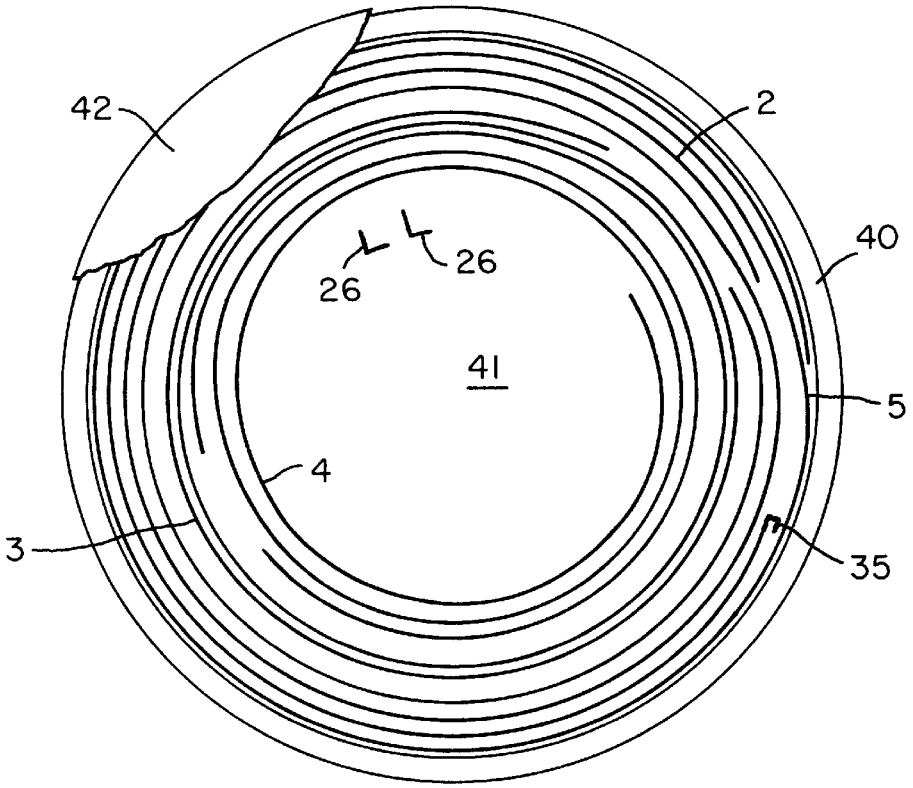
FIG. 12 is an enlarged top plan view showing some of the components from the wall assembly of FIG. 1 disassembled and packed for shipping or storage.

The sheet material from which panels 5 are made should be flexible enough to permit the panel to be rolled into a coil for storage and transportation, as shown in FIG. 12, yet the material should have enough body to provide a smooth attractive wall surface for the wall assembly 1. The same thin flat sheet material described above with reference to sheets 6 may be used for sheets 20, and, preferably, a fabric facing should be applied to such plastic material to give the wall panel 5 an attractive appearance.

Figure 8:
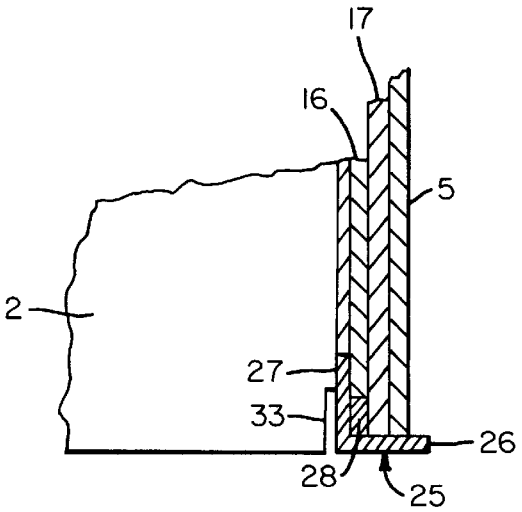
FIG. 8 is an enlarged, fragmentary cross sectional view taken generally along the line 8—8 in FIG. 2.
Figure 9:
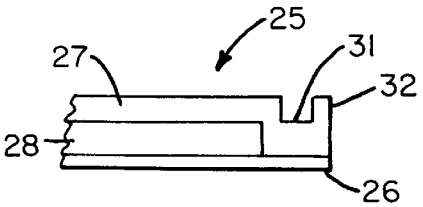
FIG. 9 is an enlarged fragmentary side view of a bottom connector.
Figure 10:
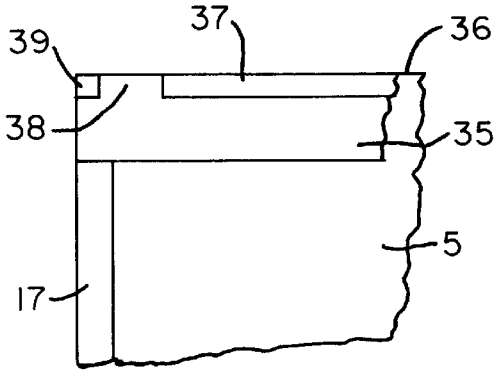
FIG. 10 is an enlarged fragmentary plan view of a corner of the wall panel in FIG. 4.

Wall assembly 1 may also employ one or more bottom connector means 25 located between columns 2, 3 and 4 for straightening the bottom of wall panel 5. Connector means 25 may be made from L-shaped angle members 26 having vertical surfaces 27. Third releasable fastener means 28 should be attached to vertical surfaces 27 and mating releasable fastener means 29 should be attached to the lowermost edge 30 of each panel 5 on the inside surface of sheet 20. Fastener means 28 and 29 may be of the same type described herein with reference to fastener means 10. Vertical surface 27 should have indentations at 31 adjacent each of its ends to define end tabs 32 for locating and positioning the connector means 25 and support columns with respect to each other. Each sheet 6 should have one or more notches 33 in its lowest edge adjacent fastening means 16. When the wall is erected, each end tab 32 is passed through a notch 33 into the inside of an upright column, with the notched edge of the sheet 6 being located within an indentation 29. As shown in FIG. 8, the vertical surface 27 is taller than the height of the notches 33, so, the edge of the column will be held by the tab 32 to accurately position the bottom connector means 25.

Figure 11:
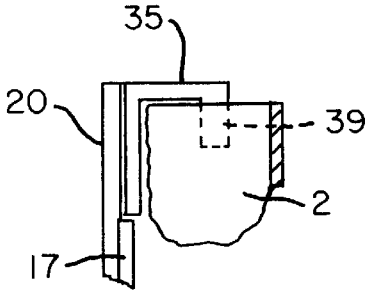
FIG. 11 is an enlarged fragmentary end view taken generally along the line 11—11 in FIG. 1.

An angled top support bracket 35 is attached to the full width of the uppermost edge 36 of each wall panel 5 to prevent the edges 36 from sagging. Each bracket 35 has a downwardly extending flange 37. Gaps 38 are cut into flange 37 adjacent each of its ends to define end hooks 39 at each end of the bracket. The end hooks 39 pass over the tops of the columns and extend into the interior of the columns, as shown in FIG. 11, so as to connect the brackets and columns to each other.

Figure 3:
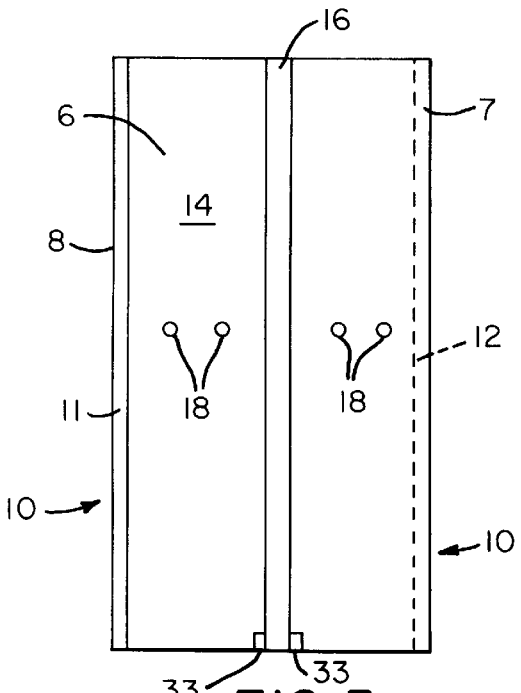
FIG. 3 is a top plan view of a column sheet.
Figure 4:
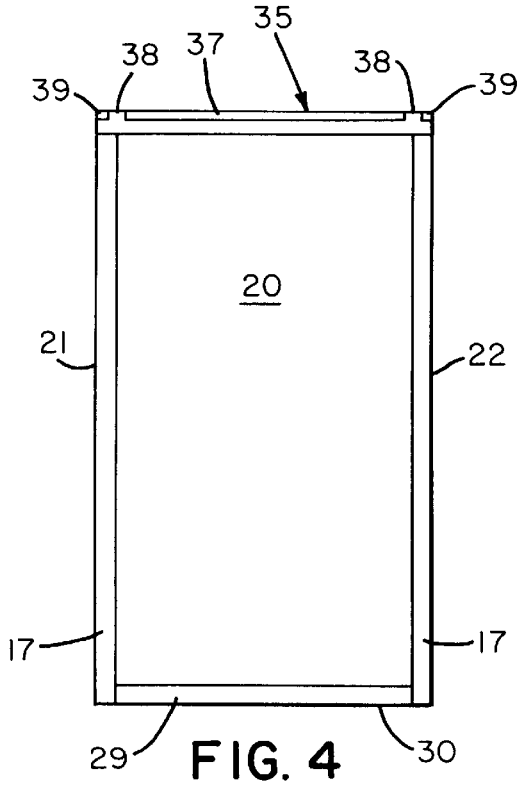
FIG. 4 is a top plan view of a wall sheet.

FIG. 12 illustrates the simple compact form into which wall assembly 1 can be broken down for storage and shipment. To disassemble the wall, end hooks 39 would be moved out of engagement with the top of the columns, and the mating members of the second and third fastener means would be separated from each other. Wall panels 5 could then be laid out flat as shown in FIG. 4. Each wall panel 5 would then be rolled upon itself toward its support bracket 35 into a relatively compact spiral, and the spiral would be placed in a cylindrical container 40 having a bottom 41. Then the mating members of first fastening means 10 would be separated, and each sheet 6 would be laid out flat as shown in FIG. 3. The sheets 6 could be rolled up upon themselves into compact spirals that are tighter than the spiral defined by wall panels 5. The spiraled sheets 6 would then be nested one inside the other and placed inside of rolled up wall panel 5 in container 40, as shown. Angle members 26 would then be placed inside of the coiled sheets 6, and a suitable lid 42 could then be placed on the container 40.

The practice of this invention also includes methods of assembling, disassembling and storing portable walls that do not require skilled workers or special tools. The releasable fastener members 11 and 12 that are applied to the opposite edges of each sheet 6 facilitate coiling of the sheet upon itself into a cylindrical support column simply by placing the sheet 6 on a flat surface, such as a floor, and then rolling the sheet by hand until the edges overlap, at which time the fastener members can be connected to each other by pressing them together. By applying second fastening means 16 to the side of the sheets 6 that become the outside surfaces of the columns, the fastening means 17 applied to the wall panel 5 can be quickly attached to and removed from the mating fastening means on the support columns. The top and bottom edges 30 and 36 of each wall panel 5 are straightened and held in place by connecting the bottom edges to bottom connectors 25 and adhering support brackets 35 to the top edges. To Disassemble and store the wall assembly 1, the fasteners holding sheets 6 and 20 together would be disengaged, and the respective sheets laid out flat. Then each sheet would be wound upon itself into a tight spiral, and the spiraled sheet would be placed inside of a circular container. Successive sheets would be wound into successively tighter spirals so that each sheet could be nested inside of the previously spiraled sheet. This results in a compact bundle for storage and transportation of the wall assembly.

While the present invention has been described with reference to particular embodiments, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A portable wall comprising:

A. an elongated, hollow, open-ended wall support column; said support column comprising an essentially rectangular sheet of flexible material having a pair of parallel opposite side edges; first releasable fastening means comprising a pair of mating fastener members located adjacent said opposite sides edges of said rectangular sheet and wherein one of said mating fastener members is attached to one surface of said rectangular sheet and the other of said mating fastener members is attached to the opposite surface of said rectangular sheet, and said opposite edges overlap so as to cause said mating fastener members on the opposite surfaces to connect with each other; said rectangular sheet being coiled upon itself to the extent that said opposite side edges are adjacent for enabling said mating fastener members to connect to each other so that said column is shaped essentially like a right, circular cylinder; said rectangular sheet being made from material that is sufficiently rigid that it is self-supporting when coiled into such column of cylindrical shape; and B. wall means, and means for releasably holding said wall means on said column.

2. The portable wall defined in claim 1, further comprising said column having second releasable fastening means on its surface which defines the outside of said cylinder; and said wall means has releasable fastening means for mating with said second releasable fastening means on said column so as to connect said wall means to said column.

3. The portable wall defined in claim 2, wherein said wall means comprises a plurality of said support columns that are spaced apart; and said wall means comprises a wall panel comprising a sheet of wall material dimensioned for spanning the space between the spaced columns, said releasable fastening means of said wall means being located adjacent opposite edges of said sheet of wall material and mating with said second releasable fastening means on said columns so as to hold said sheet of wall material upright against said columns.

4. The portable wall defined in claim 3, wherein said sheet of wall material is sufficiently flexible to be coiled into an essentially cylindrical shape when said sheet has been removed from support by said columns.

5. The portable wall defined in claim 3, further comprising bottom connector means between said columns, said bottom connector means comprising third releasable fastener means, and said wall means having releasable fastener means adjacent its lowermost edge mating with said third releasable fastener means.

6. The portable wall defined in claimed 5 wherein said bottom connector means comprises an L-shaped angle member and said third fastener means is attached to a vertical surface of said angle member.

7. The portable wall defined in claim 1, further comprising support bracket means attached to an upper edge of said wall means, and said support bracket means defining end hooks that extend into open ends at the top of said columns for supporting said wall.

8. A portable wall comprising:

A. a plurality of spaced, elongated, hollow, open-ended wall support columns; each of said support columns comprising an essentially rectangular sheet of flexible material having a pair of parallel opposite side edges; first releasable fastening means comprising a pair of mating fastener members located adjacent said opposite side edges of said rectangular sheet; one of said mating fastener members being attached to one surface of said rectangular sheet and the other of said mating fastener members being attached to the opposite surface of said rectangular sheet; said rectangular sheet being coiled upon itself to the extent that said opposite side edges overlap, and said mating fastening members on the opposite surfaces being connected to each other so that each of said columns is shaped essentially like a right, circular cylinder; each of said columns having second releasable fastening means on its surface which defines the outside of one of said cylinders; said rectangular sheet being made from material that is sufficiently rigid that it is self-supporting when coiled into such column of cylindrical shape; and B. a wall panel comprising a sheet of flexible material dimensioned for spanning the space between said columns; releasable fastening means located adjacent opposite edges of said sheet of wall material and mating with said second releasable fastening means on said columns so as to hold said sheet of wall material upright against said columns, and said sheet of wall material being sufficiently flexible to be coiled into a spiral shape when said sheet has been removed from support by said columns.

9. The portable wall defined in claim 8, further comprising bottom connector means between said columns, said bottom connector means comprising an L-shaped angle member, third releasable fastener means attached to a vertical surface of said angle member, said wall panel having releasable fastener means adjacent its lowermost edge mating with said third releasable fastener means, there being notches through the bottom of said columns, and said angle member having end tabs that extend through said notches into the interior of said columns.

10. The portable wall defined in claim 8, further comprising a support bracket attached to the uppermost edge of said wall panel, said support bracket defining end hooks that pass over the open upper ends of said columns.

11. A method of making a portable wall comprising the steps of:

A. applying releasable mating fastener members adjacent opposite side edges of a flat rectangular sheet of flexible material;

B. coiling said sheet upon itself until said sheet defines a hollow essentially right circular cylindrical support column that is open at its top and bottom ends;

C. connecting said spaced mating fastener members to each other so as to hold said sheet in the shape of said cylindrical support column;

D. connecting wall means to said support column;

E. applying said mating fastener members to opposite surfaces of said sheet; and F. overlapping said opposite edges to enable said releasable fastener members to mate with each other.

12. The method of making a portable wall as defined in claim 11, further comprising applying additional releasable fastener members to an outside surface of said support column, applying releasable fastener members to said wall means for mating with said additional fastener members, and connecting such fastener members so as to releasably support said wall means on said column.

13. The method of making a portable wall as defined in claim 11, further comprising attaching a top edge of said wall means to supporting means, inserting said supporting means into the open top end of said column, connecting a bottom edge of said wall means to connector means, and inserting said connector means into the open bottom end of said column.

14. The method of making a portable wall as defined in claim 11, comprising the steps of:

A. disconnecting said wall means from said column;

B. coiling said wall means upon itself into a spiral;

C. disconnecting said mating fastener members;

D. rolling said sheet out flat;

E. coiling said sheet upon itself into a spiral that is tighter than the spiral defined by said wall means; and F. nesting the spiraled sheet within the spiral defined by said wall means.

* * * * *